United States Patent [19]

McCord

[11] 4,043,474

[45] Aug. 23, 1977

[54] CHILD RESISTANT CLOSURE FOR A CONTAINER

[75] Inventor: William F. McCord, Fanwood, N.J.

[73] Assignee: American Home Products Corporation, New York, N.Y.

[21] Appl. No.: 697,289

[22] Filed: June 17, 1976

Related U.S. Application Data

[63] Continuation-in-part of Ser. No. 585,020, June 9, 1975, abandoned, which is a continuation of Ser. No. 405,372, Oct. 11, 1973, abandoned.

[51] Int. Cl.[2] ..... B65D 55/02; B65D 85/56 A61J 1/00

[52] U.S. Cl. ..... 215/211; 215/206; 215/224; 220/307

[58] Field of Search ..... 220/307, 257; 215/211, 215/206, 214; 222/563, 554

[56] References Cited

U.S. PATENT DOCUMENTS

| | | | |
|---|---|---|---|
| 3,255,915 | 6/1966 | Scholtz | 220/257 |
| 3,669,295 | 6/1972 | Horvath | 215/206 |
| 3,704,802 | 12/1972 | Schultz | 215/214 |

*Primary Examiner*—George T. Hall
*Attorney, Agent, or Firm*—Joseph Martin Weigman

[57] ABSTRACT

The disclosure is directed to a child-resistant closure for a container which has a round dispensing orifice defined in a planar end member and one or more recesses defined in the end member adjacent the orifice. The closure member has one or more protruding lugs cooperating with the recesses. When the lugs of the closure are aligned with the recesses of the orifice, the closure may be removed with a relatively small force. When the lugs of the closure are rotated out of alignment with the recesses, a relatively large force is required to remove the closure. The closure need not be oriented with the container for sealing after factory filling.

4 Claims, 12 Drawing Figures

FIG. 1
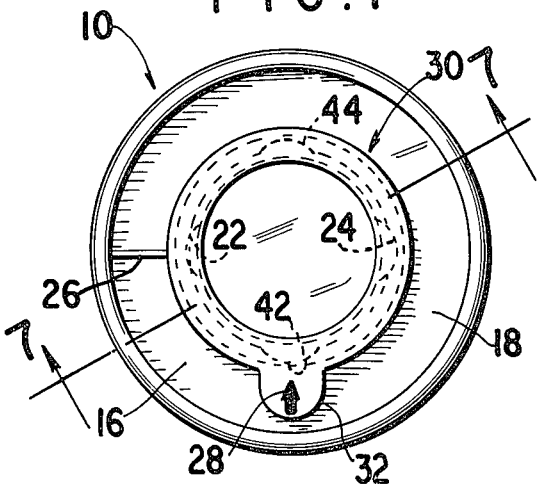
FIG. 2
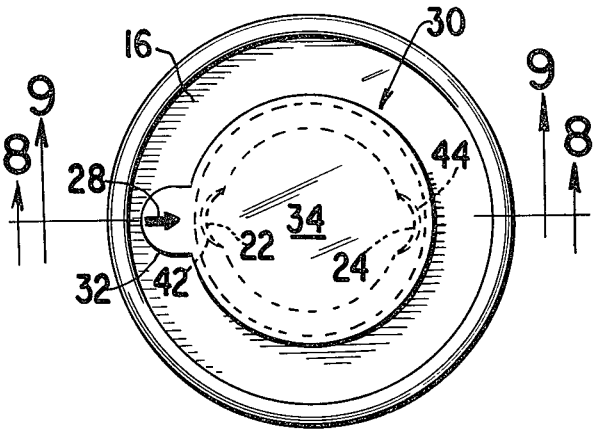
FIG. 3
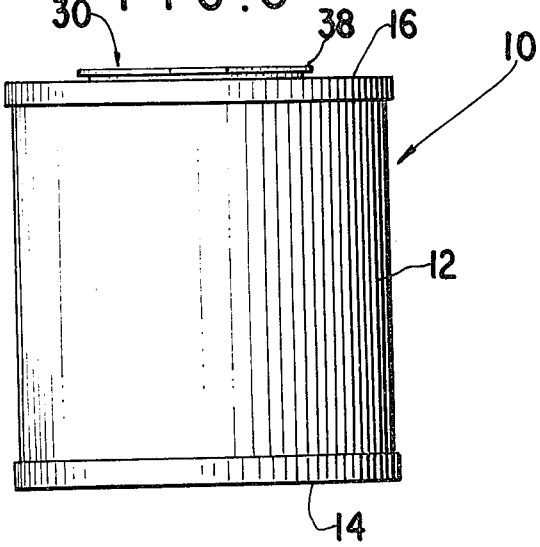
FIG. 4
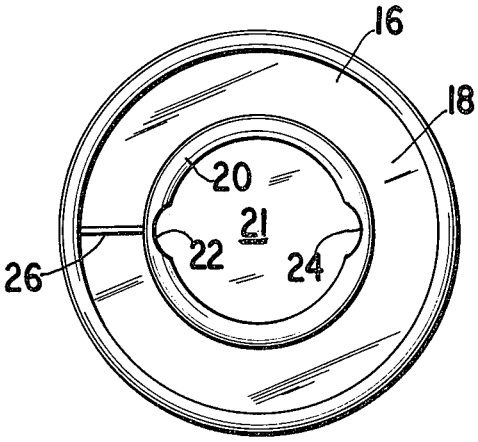
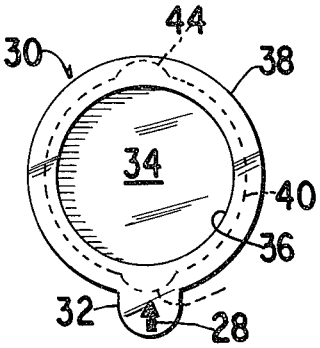
FIG. 5
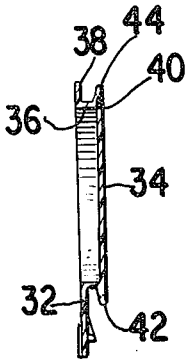
FIG. 6

FIG. 7
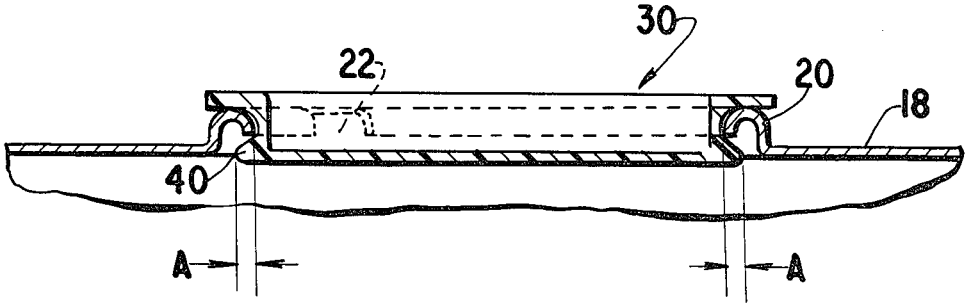
FIG. 8
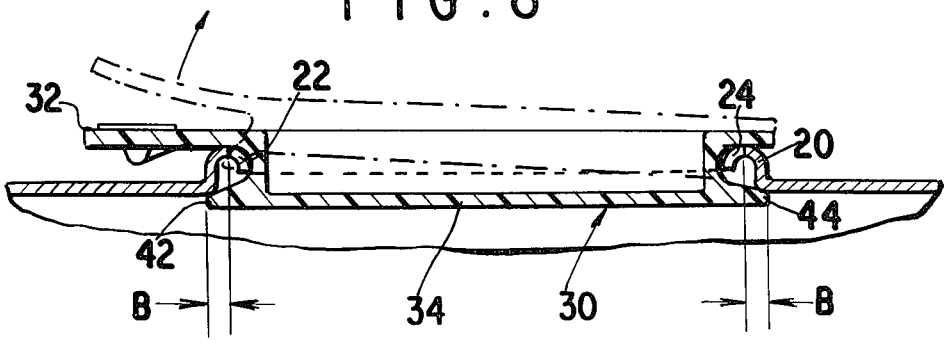
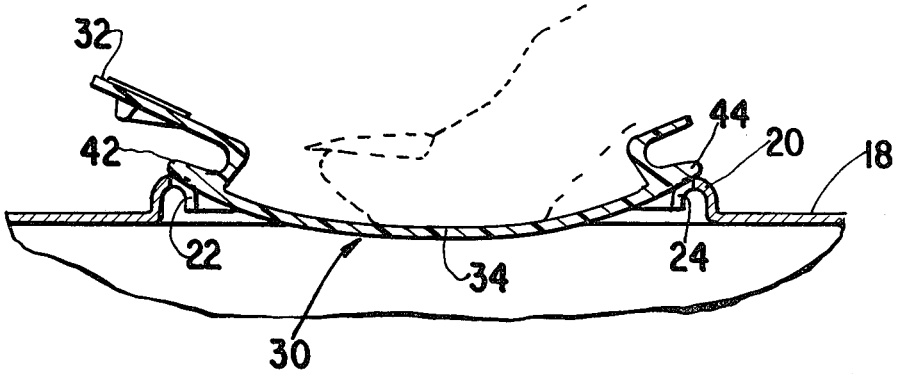
FIG. 9

CHILD RESISTANT CLOSURE FOR A CONTAINER

This application is a continuation-in-part of my application Ser. No. 585,020 filed June 9, 1975 now abandoned, which was a continuation of my application Ser. No. 405,372 filed Oct. 11, 1973, and now abandoned.

The present invention is directed to child-resistant closures and more particularly directed to a flexible, child resistant closure for a container which has a round dispensing orifice defined in a planar end member by an annular ring. One or more recesses are defined in the ring, and one or more cooperating lugs or protrusions are defined on the closure so that when the lugs are in alignment with the recesses, the closure may be pulled from the orifice with relatively little force, and when the lugs are rotated out of alignment with the recesses a relatively large force is required to remove the closure.

An inexpensive container is one which is generally cylindrical in shape made of plastic or cardboard which has a flat or planar bottom, which may be formed from plastic or metal, and a flat top also formed from plastic or metal. To dispense the contents a flexible plastic plug-type closure is provided in the middle of the top. Because such a package is relatively inexpensive it is popular for use with low profit household chemical compositions including, for instance, drain cleaners and toilet bowl cleaners. Such substances, while a household necessity, to be effective are necessarily extremely caustic and extremely dangerous if ingested. To provide a new package which is totally inaccessable to children could well destroy the profitability of a commodity being merchandized and therefore drive it from the market.

A problem which exists in the prior art then is how to make such a simple, widely used container childproof along the guidelines suggested by the government for childproof closures. The guidelines require, in general, that the package be difficult or nearly impossible for children to open but relatively simple for adults to open.

The most closely related prior art known to the applicant includes the following U.S. patents. U.S. Pat. No. 3,704,802 discloses a two member closure in which one member of the closure is firmly and permanently mounted in a planar end wall of a container, and the second member is removably mounted in the first. The second member has a series of lugs spaced at intervals around its circumference and the first member has a cooperating series of lugs around the interior of its circumference. The lugs are spaced relative to one another so that they may be engaged or disengaged by rotating the second member relative to the first member, thereby permitting the removal of the second member from the first.

Patent 3,684,116 discloses a container in which the entire end wall has lugs and slots on its outer periphery which cooperate with the inner annular side wall ends. The end wall is rotated to align the lugs, and slots for removal or to cause them to engage for sealing. There is no suggestion of the use of a residual force being required to remove the closure after rotation into position for removal. The closure must be in correct alignment before it can be appplied and thus requires special orientation capping equipment in filling at the factory. In addition the closure depends on recesses and ribs formed into the container opening at several levels. The present invention is a simpler design.

U.S. Pat. No. 3,669,295 is directed to a closure for necked bottles. The interior annulus of the orifice of the neck has a rim inwardly directed that is interrupted by grooves at predetermined intervals. An interior annulus on the closure has lugs which are adapted to pass through the interruptions or grooves in the interior annular rim of the container. The entire cap or closure may be rotated so that the lugs of the cap are aligned with the grooves of the neck. An indicator device on the neck and on the cap shows when they are aligned. A projecting tab is provided on the outside of the cap to facilitate removal of the cap. The cap may be rotated so that the lugs of the cap engage the annular ring and seal the container. The outer rim of the bottle neck has an extending annulus which cooperates with a rim on the interior of the cap to provide for joining them by a snapfit in known manner. The closure must be in correct alignment with the tabs before it can be applied at the manufacturing facilities. The closure of the present invention does not have to be in alignment with the recessed tabs when applied at the manufacturing source. The present closure may be applied by merely pushing and snapping the plug into place. Therefore special orientation capping equipment is not required.

The present closure has distinct advantages over other safety closures. In almost all other safety closures when the safety feature is removed the consumer forgets or doesn't take time to reclose so as to reactivate the safety feature. The closure of the present invention simply snaps into the container opening, and the safety feature is automatically operative.

The present invention is particularly applicable to hygroscopic products which will absorb moisture from the atmosphere if the the container opening is not resealed. On absorbing moisture the contents will cake or in some cases deteriorate. The consumer using such packages is usually knowledgeable of the consequences and will replace the closure to save the product. The present closure, simply by replacing the closure with a minimum effort, returns the container to the child-resistant position.

Other advantages of the safety closure are that it has a simple and easy to understand principle regarding orientation and removal. Moreover the closure is inexpensive when compared to other safety closures presently available on the market.

Another advantage of the present closure is that it may be used with the same capping equipment presently used for closing such containers. There is no requirement for special equipment for orienting the container and closure.

It is an object of the present invention to provide a child-resistant closure for a container having a flat end wall with a dispensing orifice in it.

It is a further object of the present invention to provide a child-resistant plug-type closure which may be applied by snap-fitting.

It is still another object of the present invention to provide a child-resistant closure of the snap-fit type in which a relatively small force is required to move it in one position and a relatively large force is required to move it in a second predetermined position.

It is another object of this invention to provide a snap-fit closure which may be oriented to require a relatively small or a relatively large removal force which requires a moderate force to move it from one orientation to the other.

It is yet another object of this invention to provide a snap-fit closure which requires different withdrawal forces in different orientations but may be applied without regard to orientation.

Other and further objects of the invention will be apparent to those skilled in the art from reading the following description in conjunction with the drawings in which:

FIG. 1 is a top plan view of a container utilizing one embodiment of the features of the present invention and showing the closure in the locked position;

FIG. 2 is a top plan view of the embodiment of FIG. 1 showing the closure rotated into position for removal;

FIG. 3 is a side elevational view of the embodiment of FIG. 1;

FIG. 4 is a top plan view of the container of the embodiment of FIG. 1 with the closure removed;

FIG. 5 is a top plan view of the closure member;

FIG. 6 is a sectional view of the closure member of FIG. 5;

FIG. 7 is a partial sectional view taken generally along lines 7—7 of FIG. 1 and showing the closure in the locked position with regard to a container;

FIG. 8 is a cross-sectional view taken generally along lines 8—8 of FIG. 2 and showing the closure in position for removal;

FIG. 9 is a cross-sectional view taken generally along lines 9—9 of FIG. 2 showing the method of replacement of the closure into the container end member;

Figure 10:
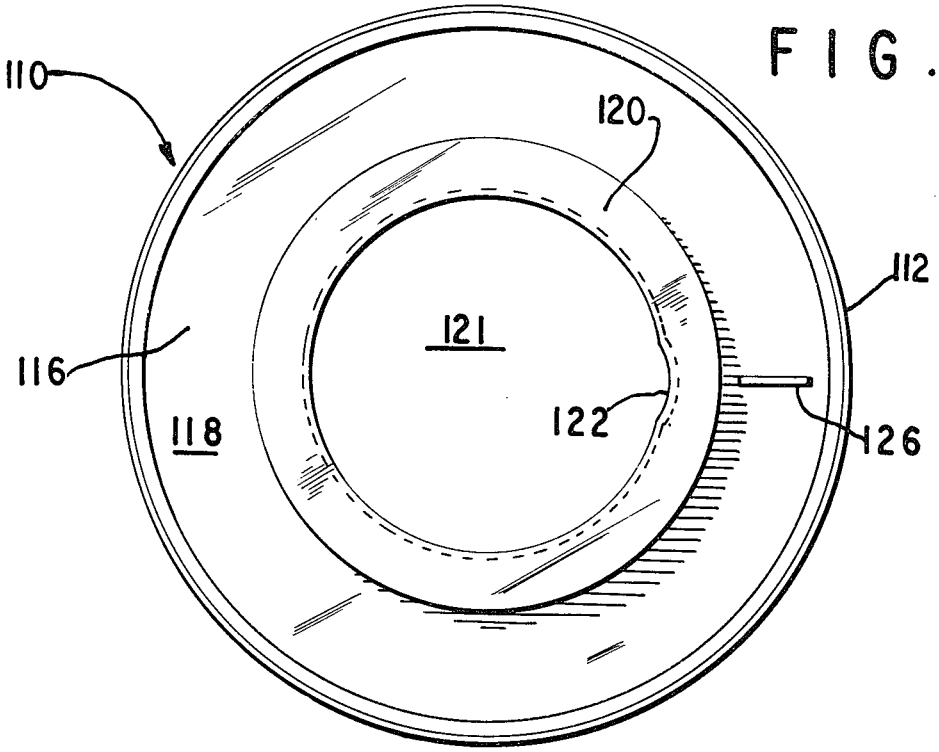
FIG. 10 is a top plan view of a preferred embodiment of a container of the present invention with the closure removed.

The objects of the invention may be achieved in a container having a closure such as that shown in the drawings. There a childproof package 10 consists of a container 12 having a fixed closed end 14 and a planar end member 16 which further consists of an annular ring 18 having a generally circular rim 20, also known as a can curl. The rim 20 may be formed as a rolled bead as is well known in the container and metal working arts. The rim 20 defines an orifice 21 through which the container contents may be filled or dispensed. As is best seen in FIGS. 4 and 8 the rim 20 has arcuate recesses 22, 24 formed in it. An indicia 26 which may be a scored line, a printed or painted mark, or the like, is permanently formed in the ring 18 in a predetermined relationship to the arcuate recesses 22, 24.

A flexible closure 30 has a tab 32 on which an indicia 28 is formed. As shown in the drawings the indicia 28 is an arrow and may be formed, as is well known in the art, as part of the closure 30 or by painting or scribing the closure 30.

As is best seen in FIGS. 5 and 6 the closure 30 further consists of a substantially round and planar member 34 which is connected by a short annular wall 36 to an upper annular ring 38. An annular flange 40 extends beyond the annular wall 36 and as may be seen in FIGS. 7 and 8, is sufficiently flexible to pass through the orifice 21 defined by the rim 20 to engage the underside of the rim to provide a tight fitting snap-fit seal between the closure and the rim. As is best seen in FIG. 7, the flange 40 of the closure 30 is larger than the interior diameter of the rim 20 by the amount "A" shown between the dimensional arrows.

The annular flange 40 has formed on it arcuate lugs 42, 44 which are located to cooperate with the arcuate recesses 22, 24 and are larger than the recesses by the amount "B" shown between the dimensional arrows.

As is shown in FIG. 9 the flexible closure 30 may be inserted into the orifice 21 by pressure with a finger when the closure is oriented according to the indicia 26, 28 so that the arcuate lugs 42, 44 are adjacent the arcuate recesses 22, 24. The resulting closure is air-tight, water-tight and moisture proof. After the closure 30 has been pushed into place, the closure is rotated to a position, as is shown in FIG. 1, so that the indicia 26, 28 are out of coincidence and therefore the arcuate lugs 42, 44 are out of coincidence with the arcuate recesses 22, 24. In this position the lugs 42, 44 offer a strong resistance to removal of the closure. When it is desired to remove the closure, the closure is rotated so that the indicia 26, 28 are again in coincidence, and the closure may be pulled free by a moderate pulling force applied to the tab 32.

Figure 11:
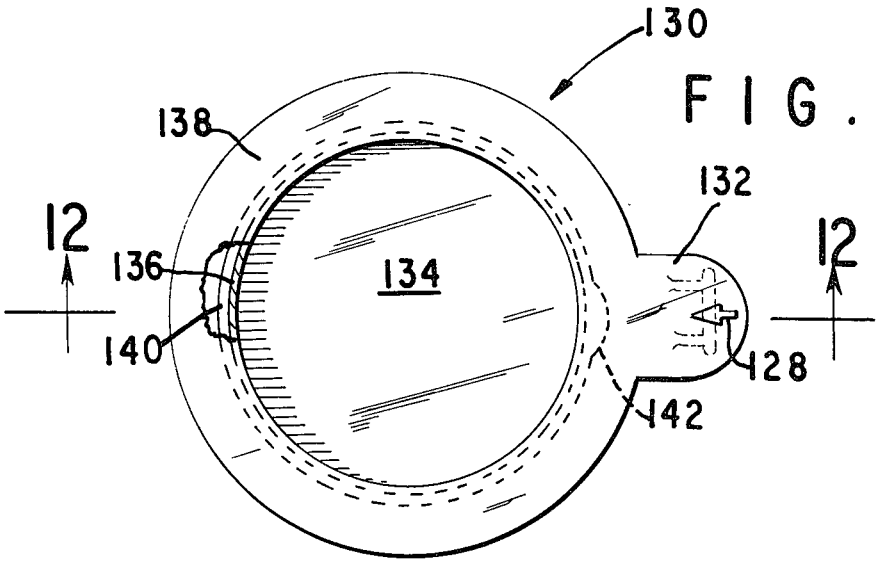
FIG. 11 is a top plan view of a closure for use with the container of FIG. 10.
Figure 12:
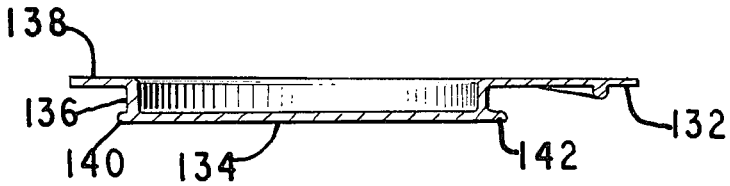
FIG. 12 is a cross-sectional view of the closure of FIG. 11.

A preferred embodiment is shown in FIGS. 10–12. There a childproof package 110 consists of a container 112 having a fixed closed end (not shown) and a planar end member 116 which further consists of an annular ring 118 having a generally circular rim 120. The rim 120 defines an orifice 121 through which the container contents may be filled or dispensed. As is best seen in FIG. 10 the rim 120 has an arcuate recess 122 formed in it. An indicia 126 is permanently formed in the ring 118 in a predetermined relationship to the arcuate recess 122. A flexible closure 130 has a tab 132 on which an indicia 128 is formed.

As is best seen in FIGS. 11 and 12, the closure 130 further consists of a substantially round and planar member 134 which is connected by a short annular wall 136 to an upper annular ring 138. An annular flange 140 extends beyond the annular wall 136 and is sufficiently flexible to pass through the orifice 121 defined by the rim 120 to engage the underside of the rim to provide a tight fitting snap-fit seal between the closure and the rim. The flange 140 of the closure 130 is larger than the interior diameter of the rim 120. The annular flange 140 has formed on it an arcuate lug 142 which is located to cooperate with the arcuate recess 122 and is larger than the recess. The operation of the closure 130 is similar to that of closure 30 as described above.

A prehensile gripping of the tab 32 or 132 is required for removal, that is, the thumb and index finger are applied. It is the prehensile grip which is least well developed in children of the dangerous age 30 to 54 months, therefore the present design offers a maximum degree of resistance to the weakest form of grip that the child can apply.

The snap-in lugs of the prior art require about five pounds of pull-off force. The safety closure in the package described can be made to increase the forces as large as desirable. For instance initial pull-off force of about 15 pounds could be achieved by controlling the size and thickness of the arcuate lug.

Likewise the rotating force required is presently large enough to assure that the child cannot rotate the closure but yet sufficiently low that an adult could. The amount of rotational force required may be controlled by the relationship of the size of the internal diameter of the rim 20 or 120 and the outer circumference of the annular wall 36 or 136.

The preferred material of construction of the closure of the preferred embodiment is high density polyethylene having high rigidity, good toughness, and excellent surface gloss. The preferred material meets the requirements of ASTM D1248-72, Type IV, class A, category 5. The preferred material has an environmental stress cracking resistance (Condition A, $F_{50}$) of 15–30 hours according to ASTM test D1693-70. Its tensile strength is 4300 psi (ASTM D638-72, Type IV Specimen), and its flexural modulus is 220,000 psi (ASTM D790-71).

The container has been described with regard to an embodiment having one recess and one lug or, alternatively, two recesses and two lugs, in which each recess and each lug is located 180° from the other. Other embodiments having more lugs and recesses are also contemplated, such as four combinations of a lug and a recess located 90° apart. Also the spacing of the lugs and recesses may be asymmetrical, provided the lugs are aligned with the recesses.

What is claimed is:

1. A child resistant dispensing package comprising:

A. A substantially cylindrical container having planar end members;

B. A dispensing orifice defined in one of said end members by a substantially circular rim;

C. At least one recess defined on the inner periphery of said rim;

D. A resistantly flexible snap-fit closure removably retained in said orifice by engagement with said rim further comprising:

1. A substantially round planar member;
2. An annular ring disposed in a plane parallel to said planar member;
3. An annular wall connecting said planar member to said ring;
4. An annular flange defined on the outer periphery of said planar member and lying in the same plane as said planar member and being of a predetermined size to be larger than the internal diameter of said rim of said container;
5. At least one lug defined on said flange in a position to cooperate with said recess defined on said rim, said lug being larger than said recess;
6. Said closure requiring a pull-off force of about 15 pounds for removal from said orifice when said recess and lug are not in orientation, whereby said flexible closure may be pressed into said orifice to close said container in any orientation, and a relativelysmall force is required to remove said closure when said lug and recess are oriented with each other.

2. A package as defined in claim 1 further comprising a tab defined on said annular ring.

3. A package as defined in claim 2 further comprising indicia on said tab and on said planar end member adjacent said orifice to indicate when said lug and said recess are aligned.

4. A child resistant dispensing package comprising:

A. A substantially cylindrical container having planar end members;

B. A dispensing orifice defined in one of said end members by a substantially circular rim;

C. At least two recesses defined on the inner periphery of said rim;

D. A resistantly flexible snap-fit closure removably retained in said orifice by engagement with said rim further comprising;

1. A substantially round planar member;
2. An annular ring disposed in a plane parallel to said planar member;
3. An annular wall connecting said planar member to said ring;
4. An annular flange defined on the outer periphery of said planar member and lying in the same plane as said planar member and being of a predetermined size to be larger than the internal diameter of said rim of said container;
5. At least two lugs defined on said flange in a position to cooperate with said recesses defined on said rim, said lugs being larger than said recesses;
6. Said closure requiring a pull-off force of about 15 pounds for removal from said orifice when said recesses and lugs are not in orientation, whereby said flexible closure may be pressed into said orifice to close said container in any orientation, and a relatively small force is required to remove said closure when said lugs and recesses are oriented with each other.

* * * * *